US005683519A

United States Patent [19]

Mannhart

[11] Patent Number: 5,683,519

[45] Date of Patent: Nov. 4, 1997

[54] METHOD OF CLEANING AND EXPOSING PORTIONS OF LIMITED LENGTH OF STRANDS OF STEEL WIRE

[75] Inventor: Alto Mannhart, München, Germany

[73] Assignee: Dyckerhoff & Widmann Aktiengesellschaft, Munich, Germany

[21] Appl. No.: 540,295

[22] Filed: Oct. 6, 1995

[30] Foreign Application Priority Data

Oct. 6, 1994 [DE] Germany ..... 44 35 744.3

[51] Int. Cl.[6] ..... B08B 1/02; B08B 7/02

[52] U.S. Cl. ..... 134/15; 134/16; 134/17; 134/40; 134/42

[58] Field of Search ..... 134/15, 16, 17, 134/42, 40

[56] References Cited

U.S. PATENT DOCUMENTS 3,646,748 3/1972 Lang ..... 57/164

3,899,365 8/1975 Guy ..... 148/6.15 R 4,064,884 12/1977 Asp ..... 134/15

*Primary Examiner*—Zeinab El-Arini

*Attorney, Agent, or Firm*—Friedrich Kueffner

[57] ABSTRACT

A method and a device for cleaning and exposing portions of limited length of strands of steel wire which are surrounded by a corrosion protection substance, particularly grease, wherein the strands of steel wire and the corrosion protection substance are enclosed by a sheathing of synthetic material. Initially, the sheathing is severed at a distance from the end of the strand corresponding to the length of the portion to be cleaned and an opening is produced. Subsequently, a flushing pipe is connected to the sheathing at the end of the strand and the strand is cleaned by admitting a flushing liquid under high pressure into the space surrounded by the sheathing, so that the corrosion protection substance and the flushing liquid emerge at the opening. Finally, the sheathing is removed entirely from the strand by pulling off the sheathing.

8 Claims, 3 Drawing Sheets

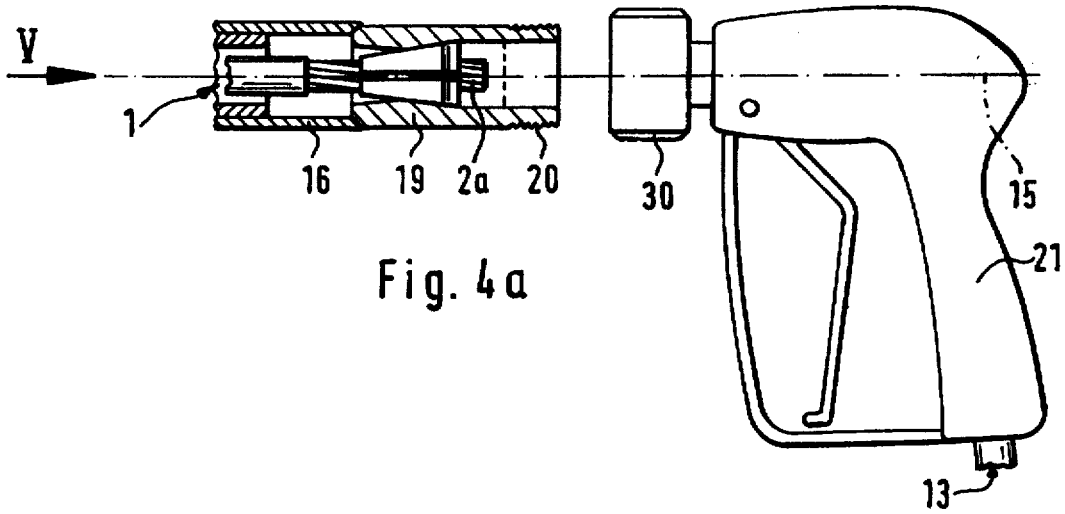
Fig. 4a
Fig. 4b
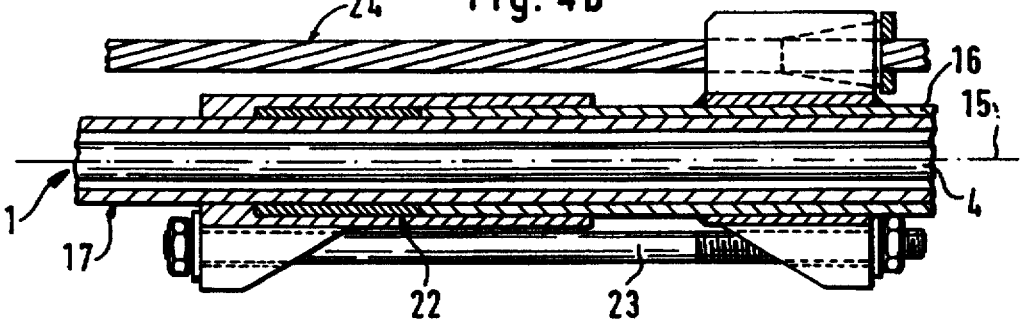
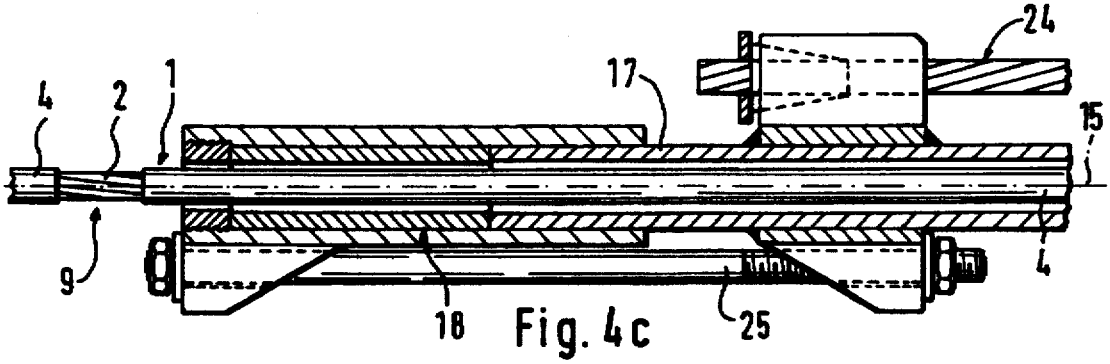
Fig. 4c
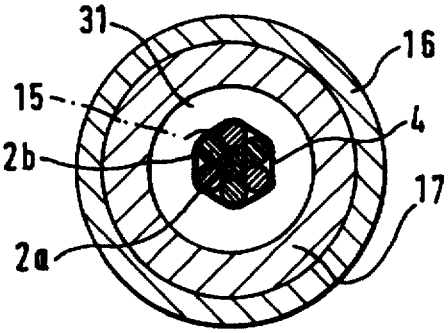
Fig. 5

METHOD OF CLEANING AND EXPOSING PORTIONS OF LIMITED LENGTH OF STRANDS OF STEEL WIRE

BACKGROUND OF THE INVENTION

1. Field of the Invention

The present invention relates to a method of cleaning and exposing portions of limited length of strands of steel wire which are surrounded by a corrosion protection substance, particularly grease, wherein the strands of steel wire and the corrosion protection substance are enclosed by a sheathing of synthetic material.

2. Description of the Related Art

Strands of twisted steel wires are frequently used in civil engineering for highly stressed tension members, for example, stay cables for cable-stayed bridges or anchoring elements for soil anchors and rock anchors. Such strands usually are composed of seven high-strength steel wires, wherein six outer wires are grouped around a straight central wire.

In order to be able to retension such strands and to embed them in concrete so as to be protected against corrosion, it is known in the art to surround the strands with a corrosion protection substance, for example, grease, which also fills out the intermediate spaces between the individual steel wires, wherein the strand protected in this manner is provided for mechanical protection with a sheathing, for example, a casing of synthetic material, for example, polyethylene, which is extruded onto the strands, as disclosed in U.S. Pat. No. 3,646,748. Additional corrosion protection is provided by a zinc layer on the surface of the steel wires.

However, in certain applications, for example, the manufacture of an anchoring system with bonding action, it is necessary to expose the strand protected in this manner at least at one end over a certain portion and to thoroughly clean the exposed portion, so that a bonding action of the strand with other media, such as, concrete, cement mortar or synthetic resin, is possible. In the past, this has been done manually by initially removing the sheathing in the respective portion and, in a second subsequent step of operation, by manually cleaning the steel wires with grease dissolving agents and brushes or by using steam jets. This is a very time consuming and expensive operation, wherein the result was not always satisfactory.

Since cutting tools must be used for removing the sheathing, there is the additional danger that the strands are damaged at the surfaces of the outer wires, particularly the zinc layers with which the wires may be provided.

Since the central wire is spirally and tightly surrounded by the outer wires, grease-filled ducts are created within the cross section of the strand, wherein these ducts cannot be treated by using the cleaning method described above. If the grease is also to be removed in these areas, it is necessary to spread apart the individual steel wires of the strand. This, in turn, means that there is the danger that the surfaces of the steel wires, particularly any zinc layers, may be damaged.

Finally, the known methods do not make it possible to separate the grease and cleaning liquid. This aspect has become of increased importance because of environmental considerations and stricter environmental regulations.

SUMMARY OF THE INVENTION

Therefore, it is the primary object of the present invention to provide a simple and economical possibility for exposing and thoroughly cleaning the strands described above.

In accordance with the present invention, initially the sheathing is severed at a distance from the end of the strand corresponding to the length of the portion to be cleaned and an opening is produced. Subsequently, a flushing pipe is connected to the sheathing at the end of the strand and the strand is cleaned by admitting a flushing liquid under high pressure into the space surrounded by the sheathing, so that the corrosion protection substance and the flushing liquid emerge at the opening. Finally, the sheathing is removed entirely from the strand by pulling off the sheathing.

A device for carrying out the above-described method includes a tubular connecting piece, wherein one end of the connecting piece is sealingly connected to the sheathing and the other end is connected to the flushing pipe.

Accordingly, the present invention is based on the concept of utilizing essentially as a flushing chamber the hollow space which is accessible from the end of the strand and is surrounded by the sheathing and filled out by the corrosion protection substance and, by admitting flushing liquid under high pressure into this hollow space, of initially forcing out the corrosion protection substance through a previously produced opening at the opposite end of the portion to be exposed and then flushing the strand with the cleaning liquid. The method and the device for carrying out the method has various advantages.

The essential advantage of the method is the fact that it is possible in a simple operation to obtain a very high cleaning effect. In particular, the use of the device according to the invention reduces manual labor to a few manipulations; the subsequent cleaning procedure takes place essentially automatically. Also, the steel wires of a strand are cleaned in a very gentle manner. Since only the flushing liquid comes into contact with the surface of the steel wires, damage to the surface of the wires, and to any zinc layers, is prevented. In addition, the ducts located within the strand cross section can be freed of grease and can be cleaned without additional measures.

Another advantage is the fact that, by admitting hot flushing liquid to the strand, the sheathing of synthetic material is simultaneously heated. Consequently, the sheathing becomes soft and resilient and can easily be pulled off from the strand after the cleaning procedure has been concluded.

Tests have shown that, when the method according to the present invention is carried out, initially the corrosion protection substance, i.e., the grease or wax, emerges at the end of the portion to be cleaned and that the cleaning liquid emerges subsequently. This makes it possible in a very simple manner to collect and possibly recover the corrosion protection substance separately from the cleaning liquid.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

BRIEF DESCRIPTION OF THE DRAWING

In the drawing:

FIGS. 4a, 4b and 4c are sectional views showing consecutive sections of another embodiment of the device according to the present invention;

FIG. 5 is a transverse sectional view as seen from arrow V; and

DESCRIPTION OF THE PREFERRED EMBODIMENTS

Figure 1:
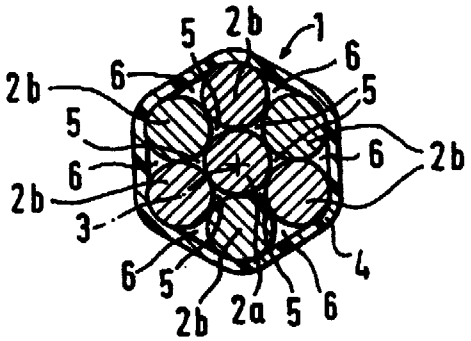
FIG. 1 is a transverse sectional view of a strand.

FIG. 1 of the drawing is a transverse sectional view of a strand 1 to be treated in accordance with the method of the present invention. The strand 1 is composed of seven steel wires, namely, a central wire 2a extending in the direction of the longitudinal axis 3 and six outer wires 2b which spirally and tightly surround the central wire 2a. The strand 1 is itself surrounded by a sheathing 4 of synthetic material, for example, polyethylene. The inner spaces between the central wire 2a and the outer wires 2b form inner ducts 5 and the outer spaces between the outer wires 2b and the sheathing 4 form outer ducts 6. The inner ducts 5 as well as the outer ducts 6 are filled with a corrosion protection substance, for example, grease.

Figure 2:
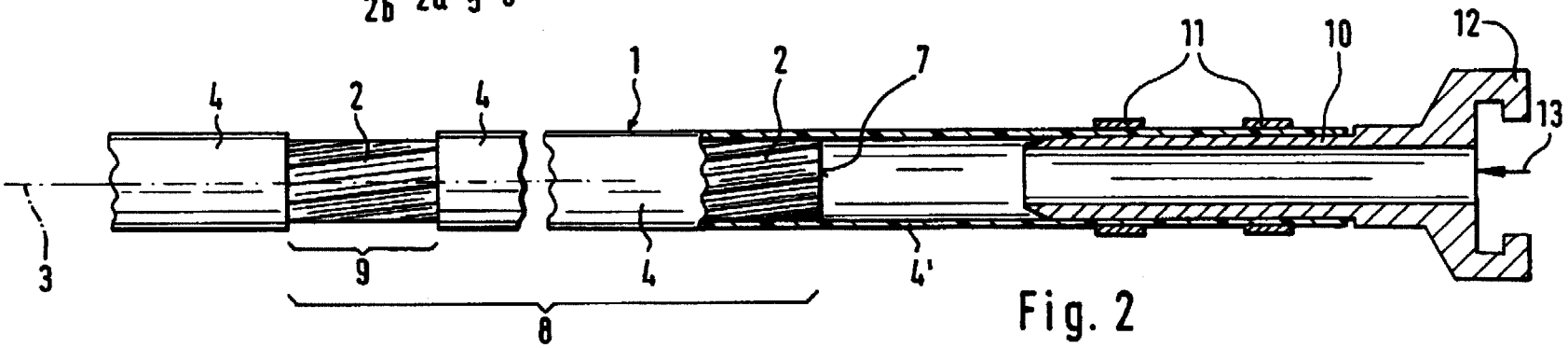
FIG. 2 is a longitudinal sectional view of a first embodiment of the device according to the present invention with a direct connection to the strand.

FIG. 2 is a longitudinal sectional view of a first embodiment of the device according to the present invention. FIG. 2 shows the end 7 of a strand 1. The sheathing 4 has been severed at a distance from the strand end 7 which corresponds to the length of the portion 8 to be cleaned and exposed and has been pulled by a certain distance over the end 7 of the strand 1. This produces an opening 9 in the sheathing 4, on the one hand, and, on the other hand, a hose-like connecting portion 4' into which a pipe piece 10 can be inserted and whose outer diameter corresponds to the inner diameter of the sheathing 4. The sheathing 4 and the pipe piece 10 are connected directly and in a pressure tight manner to each other by means of hose clamps 11. The end of the pipe piece 10 located outside of the sheathing 4 has a quick-fitting pipe coupling 12 for connection to a flushing pipe 13.

The sheathing 4 can be severed for producing the opening 9 by using a cutting tool, for example, a knife. However, it is also possible to at least partially melt the sheathing 4 by applying heat, for example, by means of an electric heating wire, and to produce an intended breaking point in this manner which bursts when the sheathing 4 is later pulled and, thus, forms the opening 9.

Figure 3:
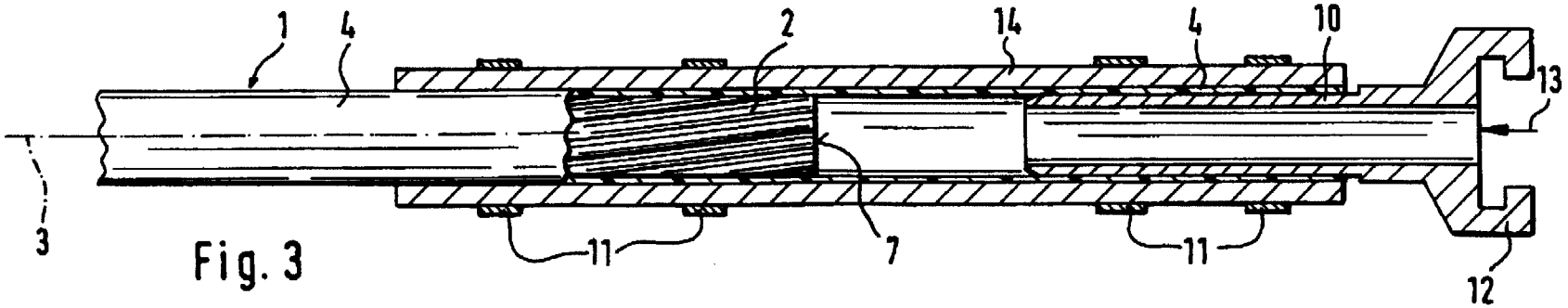
FIG. 3 is a longitudinal sectional view of another embodiment of the device according to the present invention with an indirect connection to the strand.

FIG. 3 is a longitudinal sectional view of another embodiment of the device according to the present invention. In this case, a sleeve 14 whose inner diameter corresponds to the outer diameter of the sheathing 4 is slid onto the end 7 of the strand 1 and is connected in a pressure tight manner with the sheathing 4 by means of hose clamps 11. A pipe piece 10 of the type described with respect to FIG. 2 is inserted into the other end of the sleeve 14, wherein the outer diameter of the pipe piece 10 corresponds to the inner diameter of the sleeve 14 and wherein the pipe piece 10 is also connected by means of hose clamps 11 in a pressure tight manner with the sleeve 14. Consequently, the pipe piece 10 is connected indirectly to the sheathing 4 by means of the sleeve 14. The pipe piece 10 again has at its outer end a quick-fitting pipe coupling 12 for the connection to the flushing pipe 13.

For carrying out the method according to the present invention, a flushing liquid is admitted under high pressure through the flushing pipe indicated by arrow 13 and the pipe piece 10 into the hollow space surrounded by the sheathing 4 and containing the strand 1 and the corrosion protection substance. Preferably used as flushing liquid is hot water having a temperature of approximately 100° C., wherein a flushing agent, for example, a fat solvent, may be added to the water. The pressure is limited by the strength, particularly the tightness and durability of the synthetic material of the sheathing 4; the pressure may be up to approximately 40 bars.

When flushing water is admitted to the entire hollow space within the sheathing 4, it has been observed that the corrosion protection substance emerges first at the end of the sheathing 4 in the area of the opening 9 and that the flushing water emerges subsequently. The flushing procedure can be continued until the flushing water no longer contains any residues.

The above-described and very simple and practical use of the sheathing 4 as the flushing chamber is limited by the strength of the synthetic material which does not permit very high pressures and frequently has cracks resulting from the manufacture of the sheathing. Higher pressures of up to approximately 200 bars can be applied with the use of devices as they are described in the following with the aid of FIGS. 4–6.

FIGS. 4a, 4b and 4c are longitudinal sectional views of sections of another embodiment of the device according to the present invention. A strand 1 as described with respect to FIG. 1 extends along an axis 15, wherein the device according to the invention is slid onto the portion of the strand 1 to be exposed and cleaned. The device is composed essentially of a two-component cylindrical casing whose components 16 and 17 are slidable telescopically into one another. The device further includes a stuffing box 18 arranged at the end of component 17, wherein the stuffing box 18 is connectable tightly to the sheathing 4. An anchoring unit 19 for the strand 1 is arranged at the end of the component 16. The device also includes a connector 20 to a flushing pipe 13.

FIG. 4a shows the end of the strand 1 which is to be cleaned and exposed along a certain length portion thereof. A flushing pipe 13 can initially be connected to the anchoring element 19 of the device by means of a control valve 21 in the form of a gun. The anchoring element 19, in turn, is fixedly connected to the outer component 16 of the cylindrical casing. The end of the strand 1 whose steel wires 2 are exposed in this area is fixed relative to the device in the anchoring element 19.

FIG. 4b shows the outer component 16 and the inner component 17 of the cylindrical casing. The outer component 16 is telescopically slidable relative to the inner component 17 and is connected in a pressure tight manner relative to the inner component 17 of the casing by means of a stuffing box 22. The stuffing box 22 can be compressed by means of a bolt 23. The sealing material of the stuffing box is aramide rope. The components 16 and 17 of the casing are connected to each other so as to be longitudinally adjustable by means of a strain relief unit 24.

FIG. 4c shows the end of the device according to the invention adjacent the opening 9. The end of the inner component 17 of the cylindrical casing is again connected in a pressure-tight manner by means of a stuffing box 18 to the sheathing 4 of the strand portion to be cleaned and exposed. A bolt 25 arranged at the underside of the device serves to compress the stuffing box 18. Immediately adjacent to the stuffing box 18, an opening 9 in the sheathing 4 constitutes the end of the portion 8 of the strand to be cleaned and exposed, so that the steel wires 2 located below the sheathing 4 can be seen.

In the device shown in FIGS. 4a–4c, the casing composed of the components 16 and 17 can be adjusted to different lengths of strand portions to be exposed by sliding the components 16 and 17 relative to each other. In the embodiment illustrated in FIGS. 6a and 6b, on the other hand, adjustment to different lengths is effected by joining several sections. Thus, the device according to 6a and 6b is composed of a three-part cylindrical casing 26, 27, 28, a stuffing box 18 and a connector for connection to a flushing pipe 13.

Figure 6A:
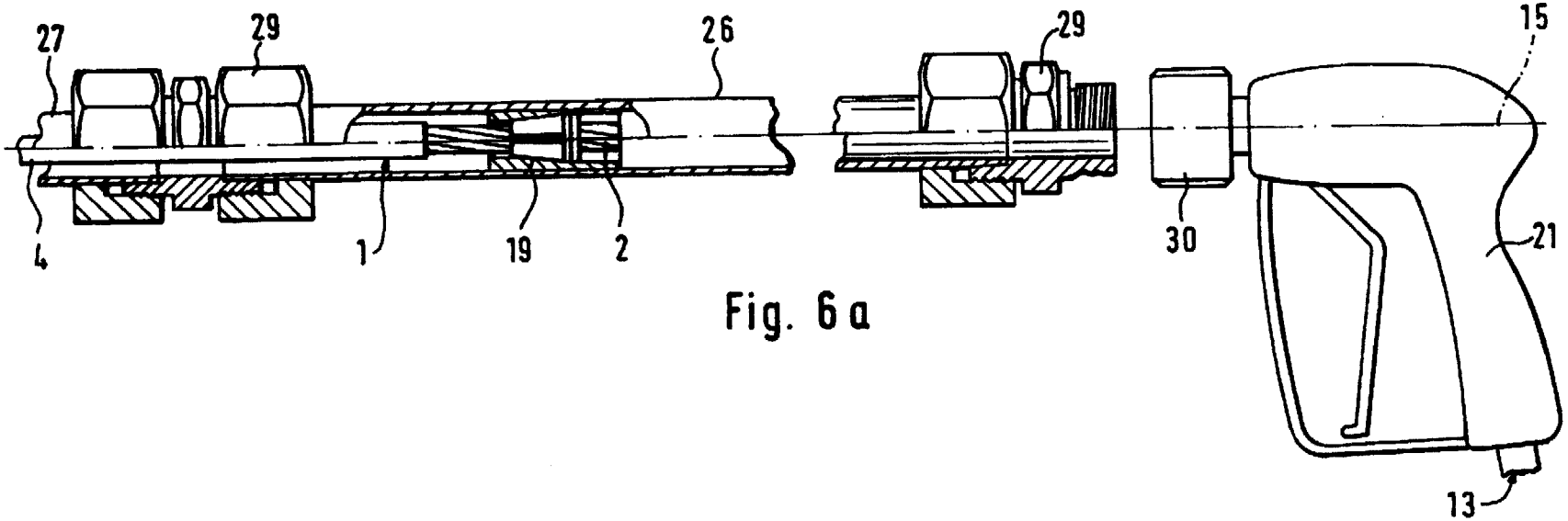
FIGS. 6a and 6b are sectional views showing consecutive sections of another embodiment of the device according to the present invention.

FIG. 6a shows a first part 26 of the cylindrical casing. The first part 26 surrounds the end of the strand 1 extending in the direction of axis 15 and to be cleaned and exposed over a certain portion 8. The interior of this first part 26 again contains an anchoring element 19 with a ring wedge which is slid onto the end of the exposed steel wires 2 of the strand 1. Screw couplings 29 are provided at both ends of the first part 26 of the cylindrical casing. Shown on the right hand side as seen in FIG. 6a is the end of the flushing line 13 with a control valve 21 in the form of a gun grip which can be connected to screw coupling 29. A second or middle part 27 of the cylindrical casing is connected to the left side of the screw coupling 29.

Figure 6B:
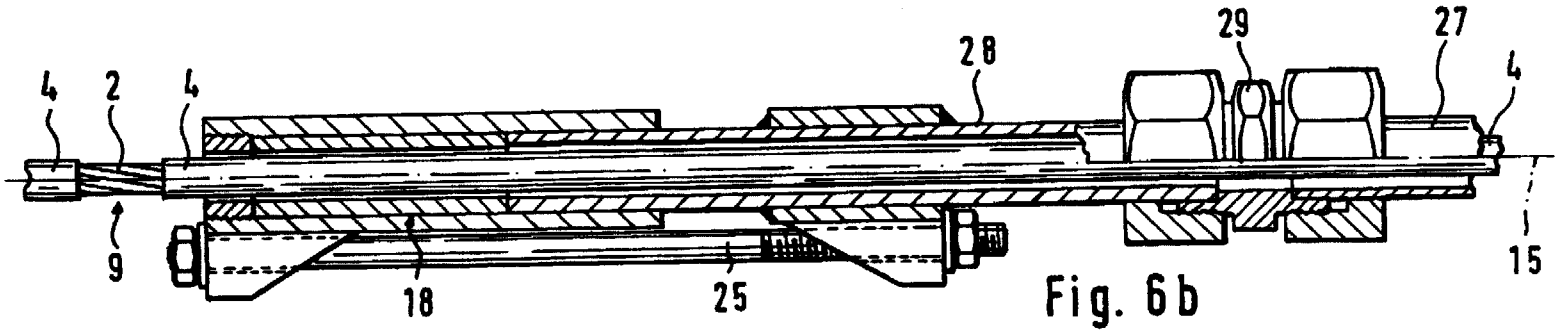

FIG. 6b shows a third part 28 of the cylindrical casing located adjacent the opening 9 of the sheathing 4. On the right hand side as seen in FIG. 6b, the third part 28 is connected to the middle part 27 of the cylindrical casing by means of a screw coupling 29. On the left side, a stuffing box 18 connects the third part 28 to the sheathing 4 in a pressure-tight manner. The stuffing box 18 can again be actuated by means of a bolt 25.

As already described above in connection with FIGS. 2 and 3, the method is also in this case carried out by initially severing the sheathing 4 of the strand 1 at a distance from the end of the strand 1 which corresponds to the length of the portion to be cleaned. The sheathing 4 is severed a second time at a location offset by approximately 5 cm in the direction toward the strand end, so that a portion of the sheathing 4 can be removed. The resulting opening 9 makes it possible that the corrosion protection substance as well as the flushing liquid can be discharged later during the flushing procedure.

Subsequently, the length of the device is adjusted to the length of the portion of the strand 1 to be cleaned and exposed. In the device according to 4a–4c, this is effected by loosening the bolt 23 which causes a pressure relief of the stuffing box 22. The locking means of the strain-relief unit 24 is then loosened and the two components 16 and 17 of the cylindrical casing are slid into one another in accordance with the length of the portion to be treated. By tightening the bolt 23, the stuffing box 22 tightly connects the outer component 16 to the inner component 17 of the cylindrical casing. Since the forces in longitudinal direction cannot be absorbed solely by the static friction of the stuffing box 22, it is necessary to previously lock the strain relief unit 24 for discharging the load.

For adjusting the length of the device according to FIGS. 6a and 6b, the fitting pieces of the cylindrical casing 26, 27, 28 are combined in accordance with the length of the portion of the strand 1 to be cleaned and exposed and are tightly connected to one another by means of screw couplings 29.

The devices prepared in this manner are then slid over the portion of the strand 1 to be cleaned and exposed, so that the stuffing box 18 at the end of the device is located immediately adjacent the opening 9. By tightening the bolt 25, the stuffing box 18 is activated and, as a result, connects the cylindrical casing in a pressure tight manner to the sheathing 4. At the opposite end of the device, the anchoring element 19, which is clamped around the steel wires 2 of the strand 1, is activated.

In all devices shown in the drawing, the end of a flushing pipe 13 is then connected by means of a coupling ring 30, wherein the flushing pipe 13 has a control valve 21 for opening and closing the flushing pipe 13. Finally, a pressurized flushing liquid is admitted to the cross section 31 formed by the sheathing 4 or the cylindrical casing, as shown in FIG. 5. The pressure may be up to approximately 200 bars.

After the flushing liquid is admitted to the cross section 31 formed by the cylindrical casing, the flushing liquid initially flows into the free space between the sheathing 4 and the cylindrical casing 16, 17 or 26, 27, 28, respectively, up to the stuffing box 18. The high pressure causes the corrosion protection substance in the ducts 5, 6 of the inner and outer areas at the steel wires to be conveyed to the opening 9 and the corrosion protection substance can be collected at the opening 9 by containers provided for this purpose. After the ducts 5, 6 of the inner and outer areas have been freed of corrosion protection substance, flushing liquid is continued to be conducted through for a short period of time, wherein this flushing liquid also flows through the opening 9 in the sheathing 4 into a container for collecting the liquid. In this manner, a high degree of cleaning is achieved which makes it possible to separate the corrosion protection substance from the flushing liquid.

After the flushing procedure has been concluded, the device according to the present invention is removed from the strand 1. Since the sheathing 4 has been heated during the flushing procedure using hot flushing liquid and since the sheathing 4 has been expanded as a result of the high pressure, the sheathing 4 can be easily plastically deformed and pulled without difficulties from the steel wires 2 of the strand 1.

While specific embodiments of the invention have been shown and described in detail to illustrate the inventive principles, it will be understood that the invention may be embodied otherwise without departing from such principles.

I claim:

1. A method of cleaning and exposing a portion of limited length of a strand of steel wire surrounded by a corrosion protection substance, wherein the strand of steel wire and the corrosion protection substance are enclosed by a sheathing of synthetic material, the method comprising the steps of severing the sheathing and producing an opening of the sheathing at a distance from an end of the strand corresponding to a length of a strand portion to be cleaned, such that a sheathing portion surrounds the strand portion; subsequently connecting a flushing pipe to the sheathing portion at the end of the strand; admitting a flushing liquid under high pressure into a space surrounded by the sheathing portion, so that the corrosion protection substance and the flushing liquid emerge at the opening; and finally removing the sheathing portion from the strand by pulling off the sheathing portion.

2. The method according to claim 1, wherein the flushing liquid is hot water.

3. The method according to claim 2, wherein the water has a temperature of approximately 100° C.

4. The method according to claim 2, comprising adding a flushing agent to the water.

5. The method according to claim 4, wherein the flushing agent is a grease solvent.

6. The method according to claim 1, comprising admitting the flushing liquid under a pressure of approximately 40–200 bars.

7. The method according to claim 1, wherein the step of connecting the flushing pipe to the sheathing portion comprises connecting a first end of a tubular connecting piece sealingly to the sheathing portion and connecting a second end of the tubular connecting piece to the flushing pipe.

8. The method according to claim 7, wherein the connecting piece includes a cylindrical casing, further comprising sliding the cylindrical casing over the strand portion to be cleaned and tightly connecting the cylindrical casing to the sheathing portion adjacent the opening.

* * * * *

UNITED STATES PATENT AND TRADEMARK OFFICE

CERTIFICATE OF CORRECTION

PATENT NO. :5,683,519
DATED :November 4, 1997
INVENTOR(S) : Mannhart

It is certified that error appears in the above-identified patent and that said Letters Patent is hereby corrected as shown below:

The title page, should be deleted to be replaced with the attached title page.

Signed and Sealed this

Twenty-first Day of April, 1998

Bruce Lehman

*Attest:*

BRUCE LEHMAN

*Attesting Officer*

*Commissioner of Patents and Trademarks*

United States Patent [19]

Mannhart

[11] Patent Number: 5,683,519

[45] Date of Patent: Nov. 4, 1997

[54] METHOD OF CLEANING AND EXPOSING PORTIONS OF LIMITED LENGTH OF STRANDS OF STEEL WIRE

[75] Inventor: Alto Mannhart, München, Germany

[73] Assignee: Dyckerhoff & Widmann Aktiengesellschaft, Munich, Germany

[21] Appl. No.: 540,295

[22] Filed: Oct. 6, 1995

[30] Foreign Application Priority Data

Oct. 6, 1994 [DE] Germany ..... 44 35 744.3

[51] Int. Cl.[6] ..... B08B 1/02; B08B 7/02

[52] U.S. Cl. ..... 134/15; 134/16; 134/17; 134/40; 134/42

[58] Field of Search ..... 134/15, 16, 17, 134/42, 40

[56] References Cited

U.S. PATENT DOCUMENTS 3,646,748 3/1972 Lang ..... 57/164

3,899,365 8/1975 Guy ..... 148/6.15 R 4,064,884 12/1977 Asp ..... 134/15

*Primary Examiner*—Zeinab El-Arini

*Attorney, Agent, or Firm*—Friedrich Kueffner

[57] ABSTRACT

A method and a device for cleaning and exposing portions of limited length of strands of steel wire which are surrounded by a corrosion protection substance, particularly grease, wherein the strands of steel wire and the corrosion protection substance are enclosed by a sheathing of synthetic material. Initially, the sheathing is severed at a distance from the end of the strand corresponding to the length of the portion to be cleaned and an opening is produced. Subsequently, a flushing pipe is connected to the sheathing at the end of the strand and the strand is cleaned by admitting a flushing liquid under high pressure into the space surrounded by the sheathing, so that the corrosion protection substance and the flushing liquid emerge at the opening. Finally, the sheathing is removed entirely from the strand by pulling off the sheathing.

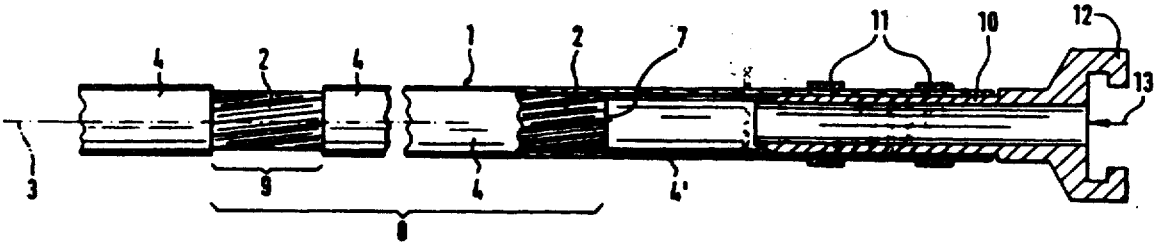

8 Claims, 3 Drawing Sheets